US007569525B2

(12) United States Patent
Heenan et al.

(10) Patent No.: US 7,569,525 B2
(45) Date of Patent: Aug. 4, 2009

(54) LUBRICANT FORMULATIONS FOR SHEET METAL PROCESSING

(75) Inventors: David F. Heenan, Kingston (CA); Krzysztof Ryszard Januszkiewicz, Inverary (CA); Réjean Lemay, Kingston (CA)

(73) Assignee: Novelis Inc., Toronto (CA)

( * ) Notice: Subject to any disclaimer, the term of this patent is extended or adjusted under 35 U.S.C. 154(b) by 442 days.

(21) Appl. No.: 11/150,714

(22) Filed: Jun. 10, 2005

(65) Prior Publication Data

US 2005/0288195 A1 Dec. 29, 2005

Related U.S. Application Data

(60) Provisional application No. 60/582,452, filed on Jun. 23, 2004.

(51) Int. Cl.
*C10M 137/10* (2006.01)

(52) U.S. Cl. ..... 508/430; 508/426

(58) Field of Classification Search ..... 508/430, 508/426

See application file for complete search history.

(56) References Cited

U.S. PATENT DOCUMENTS 2,295,192 A 9/1942 Flossmoor ..... 252/53

(Continued)

FOREIGN PATENT DOCUMENTS

EP 0 227 360 A1 7/1987

(Continued)

OTHER PUBLICATIONS

Patent Abstracts of Japan, 60166368 A2, "Thickening and Gelling Agent", Aug. 29, 1985, C09K 3/00, Umebayashi Motohisa et al.
Patent Abstracts of Japan, 08209167 A2, "Grease Composition for Resin Lubrication", Aug. 13, 1996, C10M 129/44, Yokouchi Atsushi et al.

*Primary Examiner*—Walter D Griffin
*Assistant Examiner*—Frank C Campanell
(74) *Attorney, Agent, or Firm*—Cooper & Dunham LLP

(57) ABSTRACT

A lubricant for food, beer or beverage container and container component stock is provided containing, as a conductivity enhancing additive, a phospholipid having a structure of Formula (I):

(I)

wherein $R_1$ and $R_2$ are fully saturated fatty acyl radicals derived from saturated fatty acids containing from about 10 to 22 carbon atoms; and $R_3$ is selected from the group consisting of choline, salts and mono-salts of Group I and II metals and fatty acid neutralized ethanolamine. Lubricant formulations are also described, comprising 0.5 to 50 wt % fatty acid ester of propylene glycol, 0.5 to 90 wt % petrolatum and 0.5 to 90 wt % mineral white oil. Finally, a lubricant for metalworking is described, containing as a load-bearing additive, a fatty acid monoester of propylene glycol as given by Formula (II):

(II)

wherein n is from 7 to 21 and in which the acyl moiety is hydrogenated to maximize saturation.

9 Claims, 1 Drawing Sheet

U.S. PATENT DOCUMENTS

| | | | | |
|---|---|---|---|---|
| 5,135,669 | A * | 8/1992 | Brois et al. | 508/428 |
| 5,672,401 | A * | 9/1997 | Anglin et al. | 428/64.1 |
| 6,207,286 | B1 | 3/2001 | Anglin et al. | 428/461 |
| 6,632,780 | B2 | 10/2003 | Uematsu et al. | 508/155 |
| 2002/0006519 | A1 | 1/2002 | Anglin et al. | |

FOREIGN PATENT DOCUMENTS

| | | | |
|---|---|---|---|
| JP | 60166368 | A2 | 8/1985 |
| JP | 08209167 | A2 | 8/1996 |
| WO | WO 01/46350 | | 6/2001 |

* cited by examiner

LUBRICANT FORMULATIONS FOR SHEET METAL PROCESSING

CROSS-REFERENCE TO RELATED APPLICATIONS

This application claims the priority right of applicant's prior U.S. Provisional Application Ser. No. 60/582,452, filed Jun. 23, 2004.

FIELD OF THE INVENTION

The present invention relates to lubricants used in forming or rolling sheet metal. More specifically, the invention relates to lubricant formulations that can be applied to sheet metal surfaces and that can be used in the production of various metallic objects, including non-food and food, beer and beverage packaging production.

BACKGROUND OF THE INVENTION

In metal sheet processes, lubricants are often used to facilitate cutting, stamping, bending, drawing, ironing and other forming operations required to convert a work piece into the desired product, while offering low tool wear and build up.

In the United States, some lubricant formulations used to form food, beer and beverage containers and parts of thereof must comply with the United States Food and Drug Administration (FDA) Regulation No. 21CFR178.3910.

Conventionally, kerosene-based lubricants have been used in sheet processing. However these lubricants tend to cause sticking of chaff formed during conversion operations. As well, evaporation of volatile oil lubricants contributes to the formation of volatile organic compounds (VOCs) and poses health and environmental problems.

Presently, two semi-solid pre-lubricants are commonly used as tabstock lubricants. One formulation is described in U.S. Pat. No. 5,672,401 by Alcoa, filed in 1995, herein incorporated by reference. Another material, produced by Force Industries and sold under the name AMCO 4942™, is also used. However, these lubricants have shown poor adaptability to different modes of application and work conditions.

Often, sheet metal products, such as can body sheet, are pre-lubricated prior to forming and/or post-lubricated with liquid lubricants after rolling. These liquid lubricants tend to flow off of the sheet surface during processing, or seep from the coiled sheet metal in storage and transportation, due to the generally low viscosity and/or poor wettability. To overcome this, excessive amounts of lubricant are often applied, leading to additional cost and waste.

Other lubricants, such as those composed of mono- and dilaurate esters of ethylene glycol, often used in pre-lubricated automotive sheet, tend to be overly brittle waxy solids at room temperature and tend to detach themselves from the sheet during transportation or processing.

In sheet rolling, traditional lubricant components such as fatty alcohols, fatty acids or fatty acid monoesters, such as methyl and butyl, have not always been successful in preventing strip breaks that occur due to the load of work rolls of a rolling mill and result in product quality problems.

Consequently, lubricant formula selection, and also lubricant application methods are crucial to successful use in the production of metallic articles, including food, beer and beverage containers.

At present, surface lubricants formulated in agreement with FDA Regulation 21CFR178.3910 are typically applied using roller coater or other mechanical techniques, which do not always ensure uniform surface coverage and often lead to excess deposition of lubricants on the articles.

One method that has been found to result in uniform application of lubricant is electrostatic application. The electrostatic application of surface lubricants is economically and technically desirable because it can be done at high line speeds and at precisely controllable application levels. Furthermore, because very little excess of lubricant is used, this technology allows easy switchover from one lubricant to another, and leaves a relatively small environmental imprint.

However, lubricants must have a certain level of conductivity to be applied using electrostatic applicators. Hydrocarbon and fatty acid ester or fatty acid based lubricants most commonly used in food, beer and beverage applications and formulated in accordance with FDA Regulation 21CFR178.3910 are not conductive and require conductivity enhancers in order to make them amenable to electrostatic techniques.

There are only a limited number of conductivity enhancers that are soluble in hydrocarbon-based lubricant formulations. Of these, lecithin is one of the only materials that is used commercially as a conductivity enhancer for surface lubricants, and which also meets necessary FDA requirements. However, its presence in lubricants may compromise the taste and odour of food, beer or beverages packaged in metallic containers lubricated with such lubricants.

U.S. Pat. No. 5,135,669 discloses the use of hydrogenated lecithin as a friction-modifying agent for fuels and lubricating oils, but only discusses lubricating oils for use in automatic transmissions of vehicles.

U.S. Pat. No. 2,295,192 also discloses hydrogenated lecithin as an additive for lubricating oils.

Finally, U.S. Pat. No. 6,207,286 and U.S. 2002/0006519 disclose a metal sheet product formed from food container stock. The lubricant composition contains natural lecithin as a conductivity enhancer.

It is therefore greatly desired to develop lubricants for use in the production of sheet metal products, which are safe for use on food, beer and beverage containers and provide suitable properties for metal processing. It is also desirable to find additives to lubricants that will enhance conductivity of the lubricants for electrostatic application, but which will also be substantially odour and flavour-neutral.

SUMMARY OF THE INVENTION

The present invention thus provides, in a first aspect, a lubricant for food, beer or beverage container stock and container component stock, containing, as a conductivity enhancing additive, a phospholipid having a structure of Formula (I):

(I)

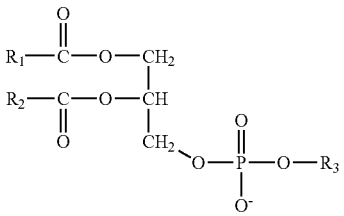

wherein $R_1$ and $R_2$ can be the same or different and are fully saturated fatty acyl radicals derived from saturated fatty acids containing from about 10 to 22 carbon atoms; and $R_3$ is selected from the group consisting of choline, salts and monosalts of Group I and II metals and fatty acid neutralized ethanolamine.

Food, beer or beverage container stock and container component stock are also provided comprising a metal sheet or foil having at least one surface thereon that comes in contact with a food, beer or beverage, which surface is lubricated with a lubricant containing, as a conductivity enhancing additive, a phospholipid of the present invention. The present invention further provides a method of lubricating food, beer or beverage container stock and container component stock, wherein the lubricant contains, as a conductivity enhancing additive, a phospholipid of the present invention. The container component stock is typically tabstock.

The present invention provides in a second aspect, lubricant formulations that can be applied as a waxy, malleable, semi-solid dressing onto a sheet metal surface, comprising 0.5 to 50 wt % fatty acid ester of propylene glycol, 0.5 to 90 wt % petrolatum and 0.5 to 90 wt % mineral white oil. A method of lubricating a sheet metal surface is also provided, comprising preparing a lubricant formulation comprising 0.5 to 50 wt % fatty acid ester of propylene glycol, 0.5 to 90 wt % petrolatum and 0.5 to 90 wt % mineral white oil and applying the lubricant formulation onto the sheet metal surface.

The present invention also generally provides lubricant formulations that can be applied as a waxy, malleable, semi-solid dressing onto a sheet metal surface comprising, as a load bearing additive, a fatty acid ester of propylene glycol.

In a third aspect, the present invention provides a lubricant or coolant for metalworking processes containing as a load-bearing additive, a fatty acid monoester of propylene glycol as given by Formula (II):

(II)

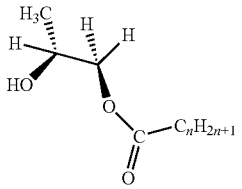

wherein n is from 7 to 21 and in which the acyl moiety is hydrogenated to maximize saturation; and a method of rolling metal stock to form metal sheet or foil comprising applying a lubricant or coolant to work rolls or to at least one surface of said metal stock, said lubricant or coolant containing, as a load bearing additive, a fatty acid monoester of propylene glycol of the present invention and rolling the lubricated metal stock to a predetermined thickness.

BRIEF DESCRIPTION OF THE DRAWINGS

The present invention will be described in conjunction with the following figure, wherein.

DETAILED DESCRIPTION OF THE PREFERED EMBODIMENTS

Figure 1:
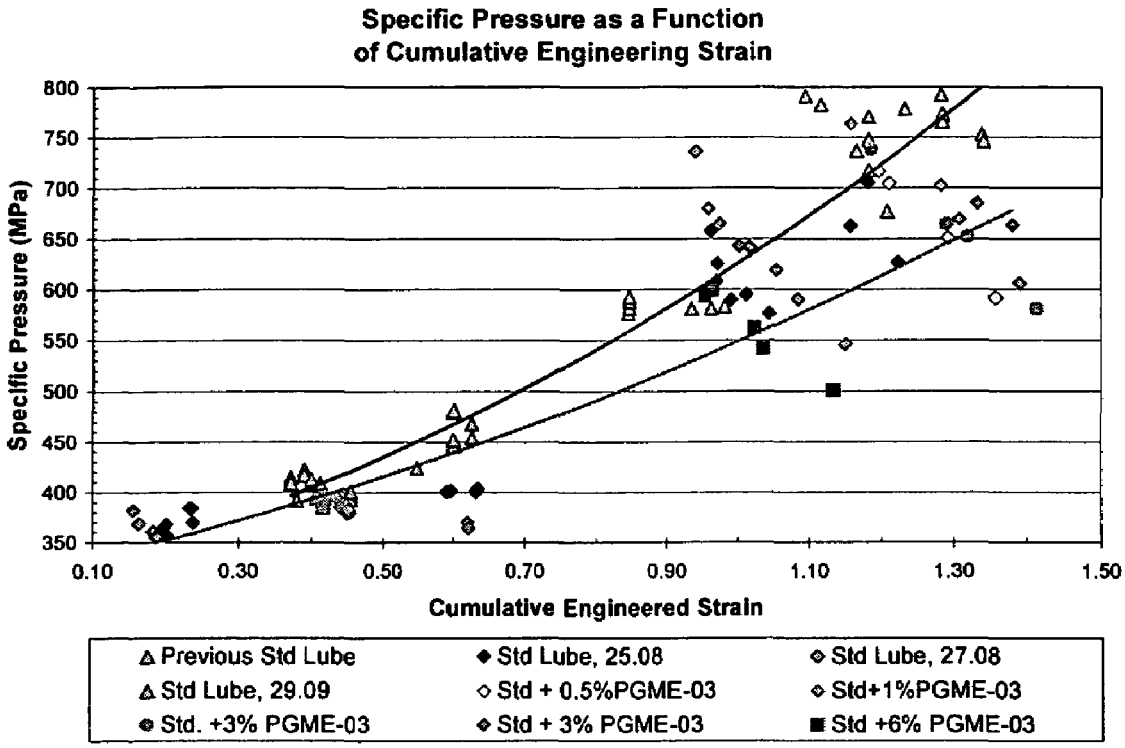
FIG. 1 is a graph showing the relationship between cumulative engineering strain and specific pressure for aluminum sheet rolling using various lubricants.

The present invention improves on traditional lubricants used in sheet metal manufacturing by the inclusion of conductivity enhancing additives to improve conductivity of the lubricant. Conductivity of the lubricant is required to enable electrostatic application of the lubricant onto a surface of the sheet metal. In electrostatic application, small charged droplets of lubricant tend to repel away from one another and are attracted towards the electrically-grounded metal sheet surface onto which they are deposited. Due to the common repulsion between droplets, droplets tend to deposit in areas without any charge, contributing to uniformity of application.

The conductivity enhancing additives proposed in the present invention are synthetic phospholipid compounds, which have ionic structural features that make them conductive. Phospholipid compounds that have only saturated fatty acid moieties present in their chemical structure have been found to be acceptable, since they are oxidatively more stable and less likely to cause off-flavour and rancid odour than a natural phospholipid, like lecithin.

The structure of one of the conductivity enhancers described in the present invention is shown below by formula (I):

(I)

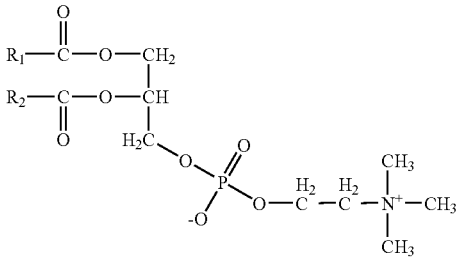

The present enhancers are similar to fatty acid glycerides, with a phosphate group replacing one of the fatty acid groups, and with an organic base attached to the phosphate group. Choline is shown above as an organic base, but ethanolamine is another possible base, with a primary amino group. The $R_1$ and $R_2$ groups in the preferred structure are completely saturated, with only single bonds to ensure flavour and oxidation neutrality.

Preferably, the carbon chain length of $R_1C{=}O$ and $R_2C{=}O$ groups is from about 10 to 22 carbon atoms, for example in a composition of 80-85% C18-stearic acid and 12-16% C16-palmitic acid. The groups may be the same length or mixed. The content of oleic acid and isomers is preferably less than 5% and linoleic and linolenic acid content is preferably below 5%, and more preferably below 2%.

The conductivity enhancing additive, represented by formula (I), has internal charges on the phosphate and amino groups which act to impart conductivity enhancement characteristics.

Optionally, other potential charged groups that may replace phosphatidyl choline are sodium and monosodium salts of phosphate or other alkaline metal salts, such as potassium salts or fatty acid neutralised-phosphoethanolamine.

Unlike natural lecithins, which are typically liquid at room temperature, synthetic hydrogenated lecithins used in the present invention are solid.

Tests have been conducted to assess the conductivity and odour of various lubricants containing the present conductivity enhancers at various concentrations of enhancer and at varying temperatures. The results of these tests are discussed in the Examples section.

A second aspect of the present invention relates to novel lubricant formulations that satisfy FDA regulation 21CFR178.3910, while also being suitable for use with the conductivity enhancers described above. For purposes of the present invention, lubricants for food, beer and beverage container stock are defined as those falling within the requirements of FDA Regulation 21CFR178.3910.

The lubricant formulation of the present invention comprises a solid fatty acid ester of propylene glycol in concentration from 0.5 wt % to 50 wt %; petrolatum in concentration from 0.5 wt % to 90 wt %; and mineral white oil in concentration from 0.5 wt % to 90 wt %. Preferably, the formulation comprises from 4 wt % to 30 wt % of a solid fatty acid monoester of propylene glycol; from 6 wt % to 75 wt % of petrolatum and from 8 wt % to 80 wt % of mineral white oil. Depending on the intended end-use of the formed article and processing steps subsequent to the forming operation, the proposed lubricant formulations may be blended using chemicals of different purities or grades, and with the incorporation of different types of functional co-additives.

Although the above components form the basic formulation of the present invention, the formulations can be tailored to suit specific forming processes, base metals, or article requirements by varying the concentrations of the above-mentioned components and/or by modifying the formulations with functional additives. Some additives may be added to enable electrostatic application of the lubricant, others to modify viscosity and load-bearing properties, whereas other additives may be added to provide emulsifying and detergency characteristics, and others to improve oxidative stability and shelf life of the product.

The three main constituents of the present invention are all commercially available in FDA approved grades for incidental or direct contact with food and beverages. The present lubricant formulation can be easily tailored to meet applicability, consistency, tackiness and tool wear and build-up requirements by varying the concentration of the three major components. The lubricants can thus be formulated to reduce jams in press operations and costs since the general formulation may be tailored for application in other metal forming operations.

Depending on the method used to apply the lubricant to the sheet metal and the end-use of the formed article, it may be desirable to introduce small amounts of functional additives to the lubricant formulation. Such additives are preferably present in concentrations of less than 10 wt %. The additives can include:

(i) load-bearing additives such as fatty alcohols, dicarboxylic acids or fatty acids and esters thereof, for instance fatty acid esters, butyl stearate, butyl palmitate, tridecyl azelate and/or dioctyl sebacate;

(ii) matrix thinners such as the esters listed above;

(iii) antioxidants such as BHT, BHA, propyl gallate or Vitamin E;

(iv) emulsifiers and detergents such as salts of amines and fatty acids, for instance those produced from triethanolamine and isostearic acid; and (v) conductivity enhancers such as hydrogenated lecithin and related compounds.

Other possible conductivity enhancers could include (a) magnesium palmitate or aluminum palmitate or stearate, (b) dihexyl esters of phosphoric acid neutralized with tetramethylnonylamines or C11-C14-alkylamines, (c) monosodium phosphate derivatives of mono- and diglycerides composed of glyceride derivatives formed by reacting mono- and diglycerides that are derived from edible sources with phosphorus pentoxide (tetraphosphorus decoxide) followed by neutralization with sodium carbonate, (d) phosphate derivatives of mono- and diglycerides produced as described above and reacted with ethanolamine and neutralized with fatty acid, and (e) sodium dodecyl sulfonate.

The amount of lubricant necessary for a particular metal forming operation depends on factors including the severity of the forming process, type of metal used, temperature before and during the forming operation, tool wear and build up, article type, and the desired surface quality. Lubricant surface application rates in excess of 300 mg/ft$^2$ are satisfactory. However, most applications require less than 100 mg/ft$^2$, preferably 20 to 80 mg/ft$^2$.

The present lubricant formulations can be applied onto metal sheet or strip prior to shipping the material to the customer onto bare, cleaned or pre-treated metal surfaces or applied just prior to the forming press. The formulations may be applied in their solid or semi-solid state at sub-ambient to ambient temperatures. It is preferable to apply the lubricant in its molten and homogeneous state.

All formulations acquire a homogeneous and single-phase system and offer ease of application upon heating, preferably to about 65° C. (150° F.). Depending on the application system used, lower or higher temperatures may also be selected. The lubricant can be applied to the substrate by various techniques including dipping, dipping and wiping, dipping and rolling, roller coating, spraying, brushing, rotary atomizing, or electrostatic application. The latter two techniques are preferred and generally require the addition of a soluble conductivity enhancer, such as those descried earlier. In electrostatic application, lubricant is heated to liquid form, but droplets of lubricant solidify on the grounded metal sheet. A solid or semi-solid lubricant is desired on the sheet metal, so that the lubricant will adhere to the sheet metal and stay intact and perform well during forming processes.

In metal rolling, the fatty acid ester of propylene glycol component of lubricant formulations acts to provide bonding between the lubricant and the metal surface and also acts as a load bearing additive to reduce friction during processing. Preferably, a fatty acid monoester of propylene glycol is used for this purpose. This component is thought to form multidentate bonding with aluminum surfaces and is more effective in reducing friction and rolling load than conventional fatty alcohol-type lubricants. This reduction of rolling loads subsequently leads to fewer rolling passes, and fewer strip breaks caused by edge cracks that are induced by excessive rolling load, and results in increased productivity. This component is most preferably used at a concentration of 0.1 to 5 wt %.

The fatty acid monoester of propylene glycol of the present invention includes the structures shown in Formula (II):

(II)

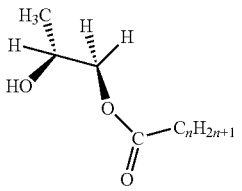

in which the acyl moiety can be composed of n carbon atoms with n being between 7 and 21, and preferably 11 to 17. The monoester can made from a feedstock of pure or purified fatty acids. It can also be produced from vegetable or animal oil feedstocks, provided that the feedstock was hydrotreated or that the final monoester was hydrotreated to remove or reduce the level of unsaturated, carbon-carbon double bonds within the acyl moieties, such that the iodine number does not exceed 5.

The fatty acid monoester of propylene glycol is thought to be capable of attaching to the aluminum surface through multiple Al—O bonds as shown in Formula (III), to provide strong affinity, or bonding, to the aluminum. The long carbon atom chain in the acyl group of the compound gives the component excellent lubrication properties.

(III)

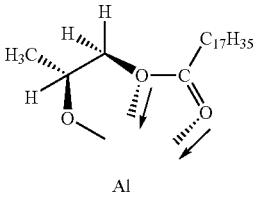

EXAMPLES

Example 1

Conductivity of Lubricants with Hydrogenated Synthetic Lecithin as a Conductivity Enhancer Table 1 shows resistivity (inverse of conductivity) measurements taken from commercially available lubricant formulations containing different concentrations of hydrogenated lecithin, commercially known as Lipoid S75-3N™, for a range of temperatures. The lubricants tested are Alcan 1A, described in the present invention, and AMCO 4942™, which comprises about 15% butyl palmitate/stearate and about 85% petrolatum.

TABLE 1

| Sample Type | Additive Concentration (%) | Temperature (° C.) | Probe Resistivity Reading (Mega Ohm) |
|---|---|---|---|
| As-is lubricant | 0.00 | 67.0 | >4000 |
| AMCO 4942 + | 0.37 | 68.0 | >500 |
| Lipoid | 0.73 | 75.0 | >500 |
| S75-3N on Heating | 1.45 | 75.0 | 90 |
| Cycle | 1.45 | 77.6 | 50 |
| | 1.45 | 78.9 | 40 |
| | 1.45 | 79.6 | 35 |
| | 1.45 | 80.5 | 30 |
| | 1.45 | 81.5 | 25 |
| | 1.45 | 82.7 | 20 |
| | 1.45 | 82.9 | 18 |
| | 1.45 | 84.7 | 15 |
| | 1.45 | 85.7 | 13 |
| | 1.45 | 86.3 | 12 |
| | 1.45 | 87.7 | 10 |
| | 1.45 | 88.7 | 9 |
| Above AMCO 4942 + | 1.45 | 87.2 | 10 |
| Lipoid | 1.45 | 77.6 | 32 |
| S75-3N on | 1.45 | 71.7 | 200 |
| Cooling Cycle | | | |
| AMCO 4942 + | 0.75 | 87.7 | 18 |
| Lipoid | 0.75 | 87.0 | 19 |
| S75-3N on | 0.75 | 85.1 | 30 |
| Cooling Cycle | 0.75 | 83.2 | 34 |
| after dissolution | 0.75 | 81.7 | 40 |
| of additive at 87.7° C. | 0.75 | 80.9 | 45 |
| | 0.75 | 80.3 | 50 |
| | 0.75 | 79.5 | 55 |

TABLE 1-continued

| Sample Type | Additive Concentration (%) | Temperature (° C.) | Probe Resistivity Reading (Mega Ohm) |
|---|---|---|---|
| | 0.75 | 79.1 | 60 |
| | 0.75 | 78.0 | 75 |
| | 0.75 | 77.5 | 80 |
| | 0.75 | 76.8 | 90 |
| | 0.75 | 75.9 | 100 |
| | 0.75 | 74.6 | 150 |
| | 0.75 | 73.2 | 200 |
| Alcan 1A + Lipoid | 0.76 | 90.7 | 30 |
| S75-3N on Cooling | 0.76 | 88.4 | 40 |
| Cycle after | 0.76 | 85.1 | 45 |
| dissolution of | 0.76 | 83.5 | 50 |
| additive at | 0.76 | 79.6 | 60 |
| 90.7° C. | 0.76 | 76.7 | 70 |
| | 0.76 | 74.4 | 80 |
| | 0.76 | 68.4 | 100 |
| | 1.24 | 90.6 | 23 |
| | 1.24 | 89.6 | 25 |
| | 1.24 | 81.5 | 35 |
| | 1.24 | 76.3 | 45 |
| | 1.24 | 71.4 | 60 |
| | 1.24 | 67.0 | 75 |

Example 2

Odour of Lubricants with Hydrogenated Synthetic Lecithin as a Conductivity Enhancer Table 2 shows odour testing results of Alcan 1A formulation and a commercially used lubricant formulated with different concentrations of the hydrogenated lecithin of the present invention, The results indicate that hydrogenated lecithin, commercially known as Lipoid S75-3N™, did not increase odours, as seen below in the odour ratings of surface lubricants.

TABLE 2

| Formulation | Arbitrary Odor Rating |
|---|---|
| Alcan A1 + 1.22% Lipoid S75-3N | 0.18 |
| AMCO 4942 + 1.23% Lipoid S75-3N | 0.25 |
| Alcan A1 + 1.24% Lipoid S75-3N | 0.28 |
| Alcan A1 + 1.22% Lipoid S75-3N | 0.58 |
| AMCO 4942 | 0.69 |
| AMCO 4942 + 0.75% Lipoid S75-3N | 0.39 |
| AMCO 4942 + 1.23% Lipoid S75-3N | 0.30 |

Example 3

Successful Lubricant Formulations

Lubricant formulations successfully trialed for forming aluminum tabs, cups and cans are given in Table 3. In these examples, Myverol P-06 K™ is a fatty acid monoester of propylene glycol, used as a thickener and load bearing component, Protopet 1S™ is a petrolatum compound, used as a thickener and Drakeol 600™ is a food-grade mineral white oil, used as a carrier. Dioctyl sebacate (DOS) is also added as a thinner and load-bearing compound to some of the formulations.

TABLE 3

| | Lubricant Formulation Composition (wt %) | | | | | | | | | | | | | |
|---|---|---|---|---|---|---|---|---|---|---|---|---|---|---|
| Component | 1C | 1A | 1D | 1E | 1B | 1F | 2B | 2A | 2C | 2D | 2E | 2F | 3A | 4A |
| Myverol P-06 K ™ | 5 | 5 | 5 | 4.75 | 4.5 | 4.25 | 10 | 10 | 10 | 9.5 | 9 | 9.5 | 15 | 25 |
| Protopet 1S ™ | 20 | 40 | 65 | 19 | 9 | 8.5 | 55 | 72 | 84 | 52.25 | 18 | 33.25 | 25 | 28.82 |
| Drakeol 600 ™ | 75 | 55 | 30 | 71.25 | 76.5 | 72.25 | 35 | 18 | 6 | 33.25 | 63 | 52.25 | 50 | 41.18 |
| DOS | 0 | 0 | 0 | 5 | 10 | 15 | 0 | 0 | 0 | 5 | 10 | 5 | 10 | 5 |
| Total | 100 | 100 | 100 | 100 | 100 | 100 | 100 | 100 | 100 | 100 | 100 | 100 | 100 | 100 |

The above lubricant formulations were applied to bare, cleaned strips of tabstock at surface concentrations of 46 to 89 mg/ft$^2$ using a laboratory-size coating machine running at 32 ft/min. The strips were 0.0110" gauge, AA5182 tabstock, 2100-2200 ft long and recoiled prior to the tab-making step. The lubricated tab strips were run on a conversion press running at 200 strokes per minute (spm), each for a nominal duration of 1.7 h. A combined total of 23,000 ft (224,000 tabs) of lubricated tab stock was processed through the press. The last 19,500 ft (187,000 tabs), representing a cumulative 15.6 hours, ran without requiring any tool cleaning. No jams or significant tool build up occurred. Tab quality was found to be satisfactory, with some formulations providing better surface scuffing protection than others.

Example 4

Cup/Can Making with Lubricant Formulation

A test was conducted to confirm that bare can body stock could also be lubricated with the present lubricant formulations, and successfully run in an otherwise conventional fashion through a cupper press, without applying any cupper lubricant, but using a bodymaker with regular coolant.

About forty feet of can body sheet was cleaned and the lubricant formulation was applied to both sides of the strips. This material was run at about 100 spm on a cupper press and the cups were conveyed to the bodymaker via the regular conveyer and track systems without sticking or delivery problems. A total of 126 cups were made and 107 of them were sent to the bodymaker. All 107 cups were continuously fed through the bodymaker running at about 300 spm, without jamming or misfeeding.

Example 5

Rolling Tests using Fatty Acid Monoester as Rolling Oil Additives

Lubricants containing fatty acid monoester of propylene glycol were tested on the laboratory rolling mill, to examine its load bearing characteristics. The monoester was used as a co-additive at 0.5 to 6% concentration in model rolling oils containing typical fatty alcohol additives and hydrocarbon as a base oil. The results in FIG. 1 show that the monoester co-additive reduces rolling load (expressed as specific pressure) by 10% as compared to the model rolling without the co-additive.

This detailed description of the methods and products is used to illustrate the prime embodiment of the present invention. It will be obvious to those skilled in the art that various modifications can be made in the present invention and that various alternative embodiments can be utilized. Therefore, it will be recognized that various modifications can be made in the products and methods of the present invention and in the applications to which the products are applied without departing from the scope of the invention, which is limited only by the appended claims.

The invention claimed is:

1. A lubricant for food, beer or beverage container stock and container component stock, containing a lubricant component that complies with United States Food and Drug Administration Regulations for food, beer or beverage containers and, as a conductivity enhancing additive, a phospholipid having a structure of Formula (I):

(I)

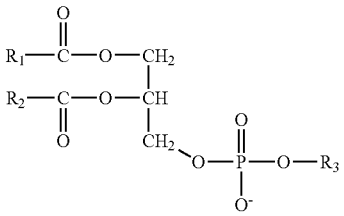

wherein $R_1$ and $R_2$ can be the same or different and are fully saturated fatty acyl radicals derived from saturated fatty acids containing from about 10 to 22 carbon atoms; and $R_3$ is selected from the group consisting of choline, salts and monosalts of Group I and II metals and fatty acid neutralized ethanolamine; said lubricant having a formulation such that it can be applied as a waxy, malleable, semi-solid dressing onto a sheet metal surface.

2. A lubricant as claimed in claim 1, wherein chains of $R_1$ and $R_2$ in the phospholipid comprise stearic acid, palmitic acid, oleic acid and linoleic acid.

3. A lubricant as claimed in claim 2, wherein the chains of $R_1$ and $R_2$ in the phospholipid comprise 80-85% stearic acid having a length of 18 carbon atoms; 12-16% palmitic acid having a length of 16 carbon atoms, less than 5% oleic acid and less than 5% linoleic acid.

4. A lubricant as claimed in claim 1, wherein the lubricant component comprises a hydrocarbon and a fatty acid ester or fatty acid.

5. A lubricant as claimed in 1, wherein the salts and monosalts of Group I and II metals comprise sodium salts, monosodium salts, potassium salts and calcium salts.

6. Food, beer or beverage container stock and container component stock comprising a metal sheet having at least one surface thereon that comes in contact with a food, beer or beverage, which surface is lubricated with a lubricant containing a lubricant component that complies with United States Food and Drug Administration Regulations for food, beer or beverage containers and, as a conductivity enhancing additive, a phospholipid of Formula (I):

(I)

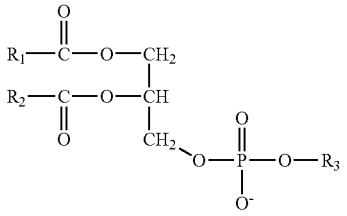

wherein $R_1$ and $R_2$ can be the same or different and are fully saturated fatty acyl radicals derived from saturated fatty acids containing from about 10 to 22 carbon atoms; and $R_3$ is selected from the group consisting of choline, salts and mono-salts of Group I and II metals and fatty acid neutralized ethanolamine; said lubricant having a formulation such that it is in the form of a waxy, malleable, semi-solid dressing on said metal sheet.

7. Container stock and container component stock as claimed in claim 6, wherein the lubricant component comprises a hydrocarbon and a fatty acid ester or fatty acid.

8. Container stock and container component stock as claimed in claim 6, wherein the salts and mono-salts of Group I and II metals of the conductivity enhancing additive comprise sodium salts, monosodium salts, potassium salts and calcium salts.

9. Container stock and container component stock as claimed in claim 6, wherein the container component stock is tabstock.

* * * * *